US011261882B2

(12) United States Patent
Dobbs

(10) Patent No.: US 11,261,882 B2
(45) Date of Patent: Mar. 1, 2022

(54) FAN CLEANER ASSEMBLY

(71) Applicant: Angel L. Dobbs, Irving, TX (US)

(72) Inventor: Angel L. Dobbs, Irving, TX (US)

( * ) Notice: Subject to any disclaimer, the term of this patent is extended or adjusted under 35 U.S.C. 154(b) by 179 days.

(21) Appl. No.: 16/416,241

(22) Filed: May 19, 2019

(65) Prior Publication Data

US 2020/0141424 A1 May 7, 2020

Related U.S. Application Data

(60) Provisional application No. 62/673,292, filed on May 18, 2018.

(51) Int. Cl.
*A47L 25/00* (2006.01)
*F04D 29/70* (2006.01)

(52) U.S. Cl.
CPC ..... *F04D 29/703* (2013.01); *A47L 25/00* (2013.01)

(58) Field of Classification Search
CPC ... A47L 25/00; A47L 4/00; A47L 4/02; A47L 9/068; A47L 9/06; A47L 13/00; A47L 13/24; A47L 13/38; F04D 29/703
See application file for complete search history.

(56) References Cited

U.S. PATENT DOCUMENTS 2,622,256 A * 12/1952 Vojacek ..... A47L 4/02 15/118
7,958,591 B1 * 6/2011 Rogers ..... B25G 1/04 15/210.1
2006/0130259 A1 * 6/2006 Collins ..... A47L 4/02 15/220.3

* cited by examiner

*Primary Examiner* — Shay Karls
(74) *Attorney, Agent, or Firm* — Wilson Daniel Swayze Jr

(57) ABSTRACT

A fan cleaning assembly.

1 Claim, 11 Drawing Sheets

FAN CLEANER ASSEMBLY

FIELD OF THE INVENTION

The present invention relates to a cleaner assembly and more particularly to a fan cleaner assembly.

BACKGROUND

As more and more people live in relatively warm climates, the use of ceiling fans have increased over the years. However since the ceiling fans are relatively inaccessible to clean there has arisen a need for a tool to clean the ceiling fans. It would be convenient if the tool could be used without the need of a ladder.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1A:
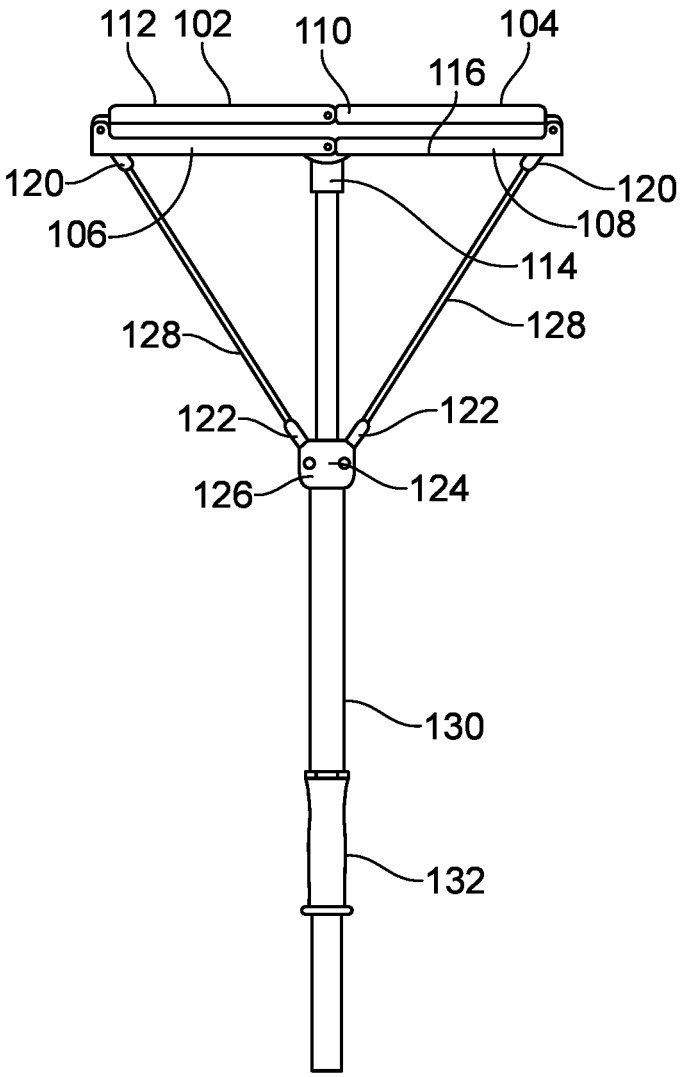
FIG. 1A and FIG. 1B illustrate the fan cleaner assembly of the present invention.
Figure 1B:
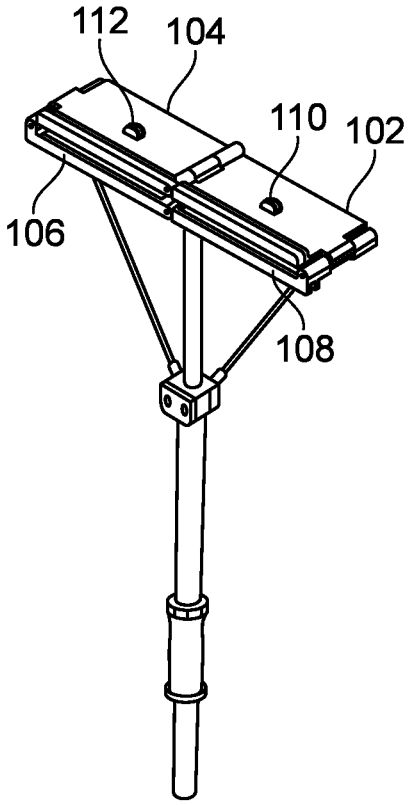

FIGS. 1*a-b* illustrate the fan cleaner assembly of the present invention.

The fan cleaner assembly may include a first pivoting plate 102, a second pivoting plate 104, the third pivoting plate 106 and the fourth pivoting plate 108 which may be formed from rigid material which may be connected to the insert member 112 which may be formed from flexible material. The pivoting plates are connected to the pivoting base member 114 which includes a base hinge member 118. The hinge member 120 may be connected to the extending arms 128 to open and close the pivoting plates. The extending arms 128 are connected to the hinge slider member 122 so that the extending arms 128 may move upwards and inwards as the pivoting plates open and close. The slider front member 124 and the slider back member 126 are mated together to connect to the hinge slider member 122 and to travel along the connector member 130.

Figure 2A:
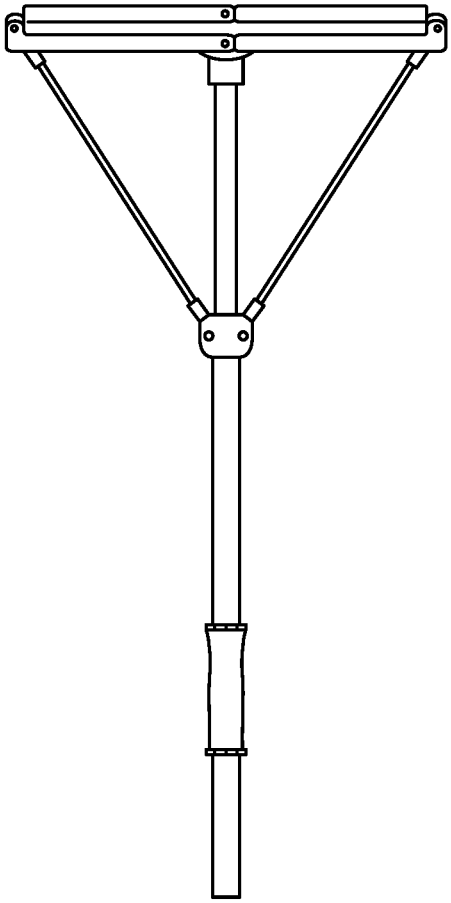
FIG. 2A and FIG. 2B illustrate the fan cleaner assembly in an open and closed position.
Figure 2B:
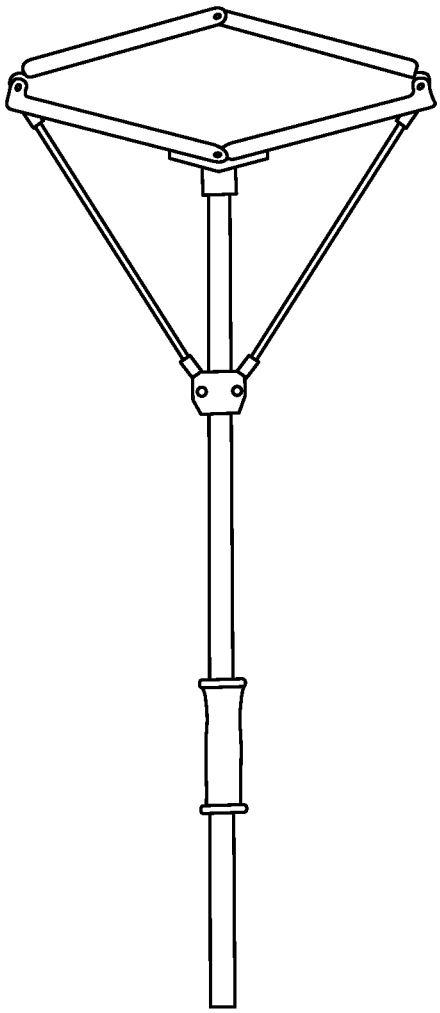

FIGS. 2*a-b* illustrate the fan cleaner assembly in an open and closed position, and illustrates a dust bag which engages the fan blades to collect dust while the fan blade is being cleaned. The bag has an elastic opening to seal the bag around the plates.

Figure 3A:
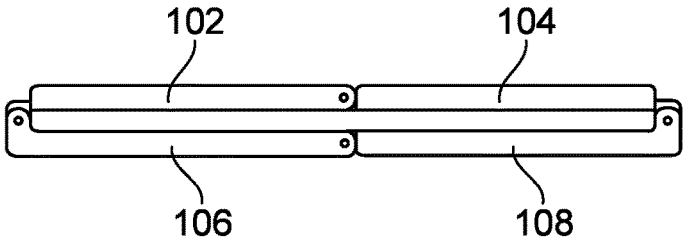
FIG. 3A, FIG. 3B FIG. 3C and FIG. 3D illustrate the pivoting plates of the present invention.
Figure 3B:
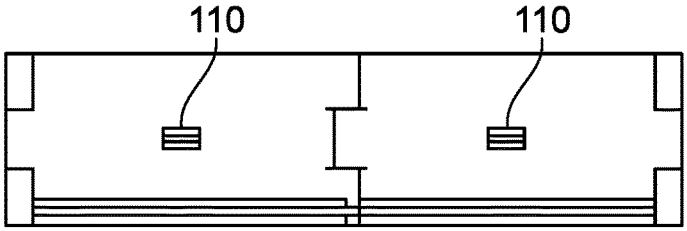
Figure 3C:
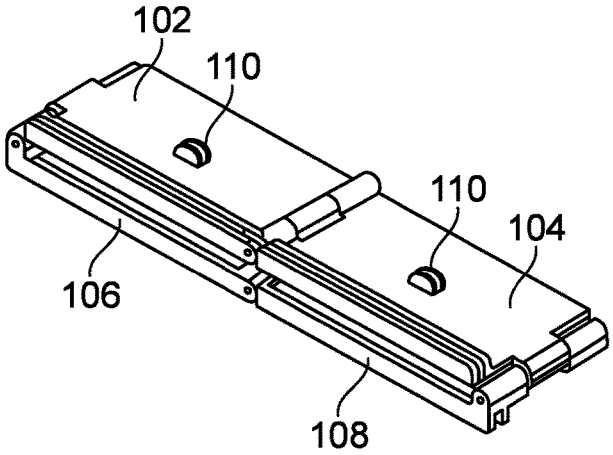
Figure 3D:
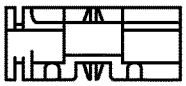
Figure 4A:
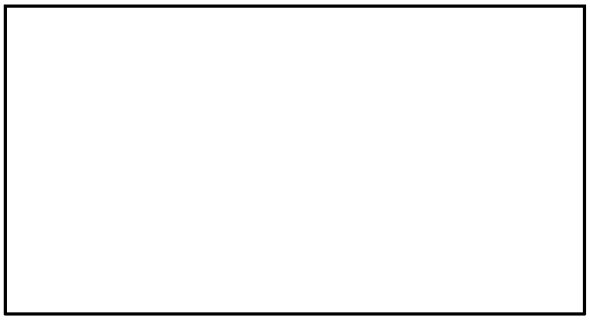
FIG. 4A FIG. 4B FIG. 4C and FIG. 4D illustrate an insert member of the present invention.
Figure 4B:
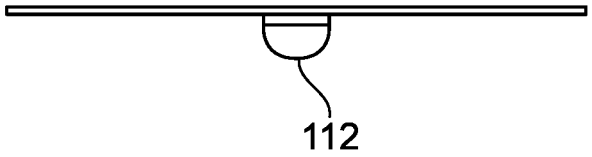
Figure 4C:
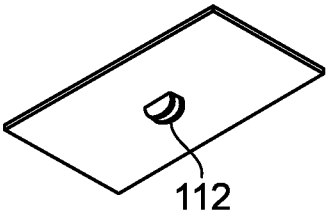
Figure 4D:
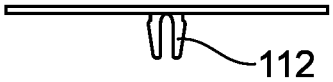
Figure 5A:
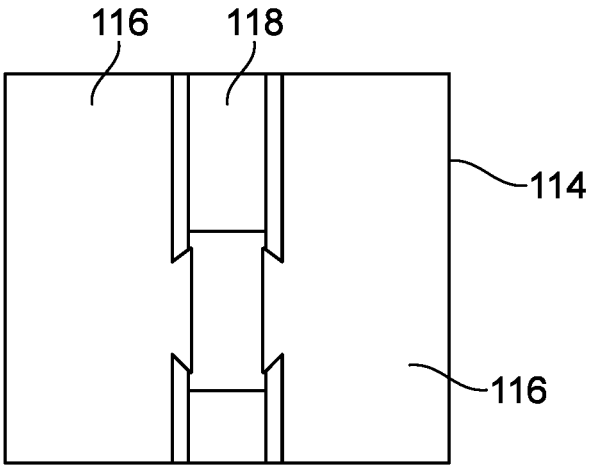
FIG. 5A FIG. 5B FIG. 5C and FIG. 5D illustrate an pivoting base member of the present invention.
Figure 5B:
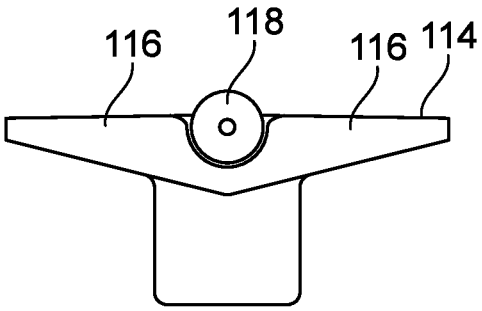
Figure 5C:
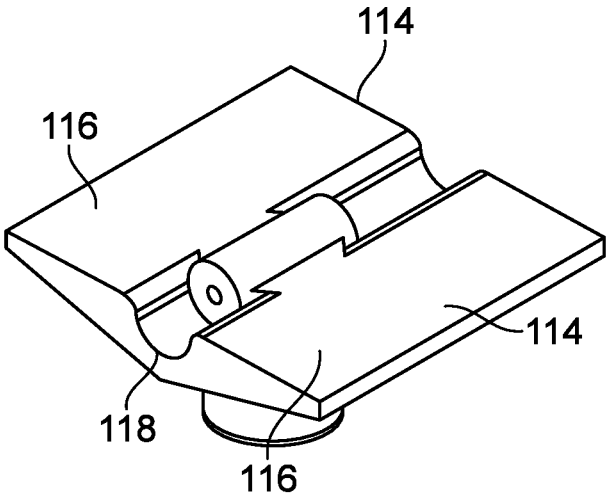
Figure 5D:
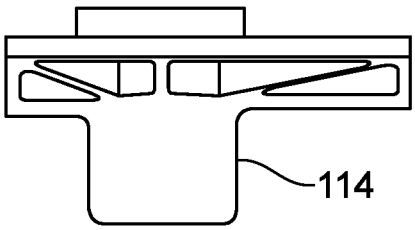
Figure 6A:
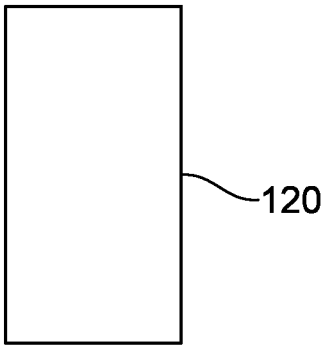
FIG. 6A FIG. 6B FIG. 6C and FIG. 6D illustrate a hinge member of the present invention.
Figure 6B:
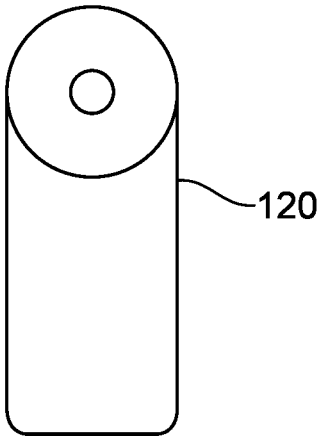
Figure 6C:
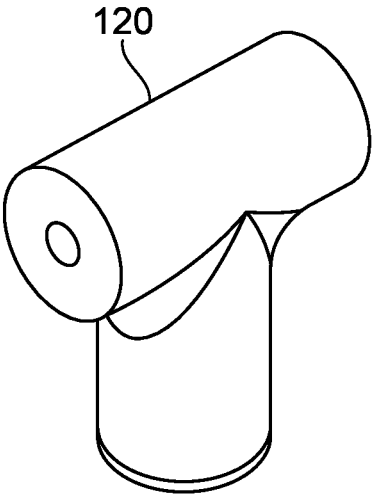
Figure 6D:
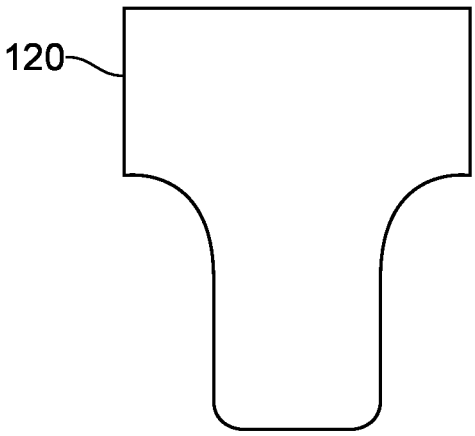
Figure 7A:
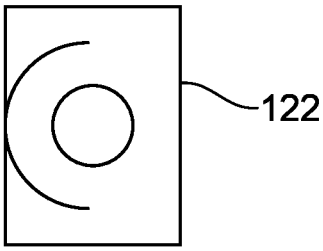
FIG. 7A FIG. 7B FIG. 7C and FIG. 7D illustrate a hinge slider member of the present invention.
Figure 7B:
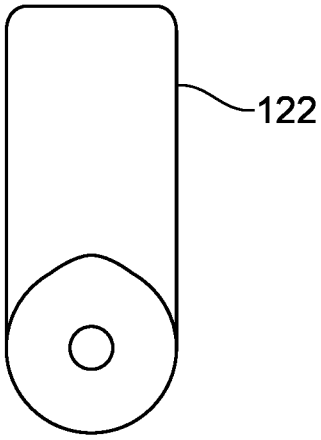
Figure 7C:
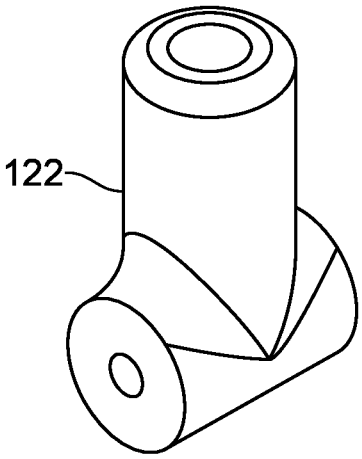
Figure 7D:
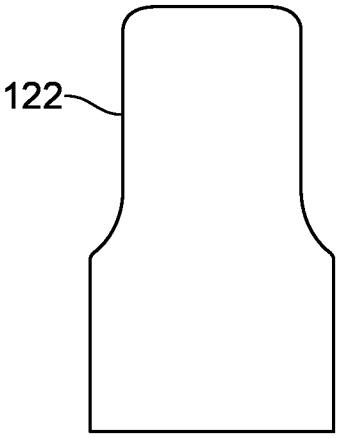
Figure 8A:
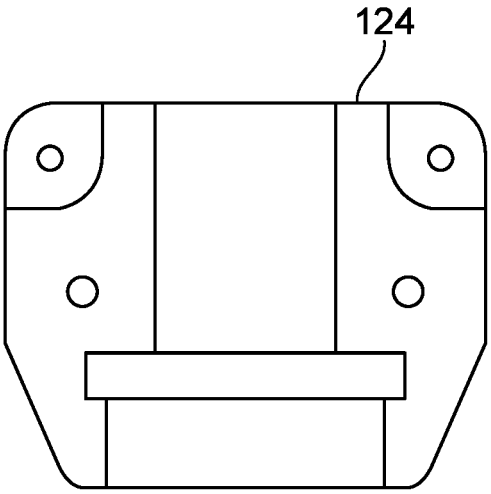
FIG. 8A FIG. 8B FIG. 8C and FIG. 8D illustrate a slider front member of the present invention.
Figure 8B:
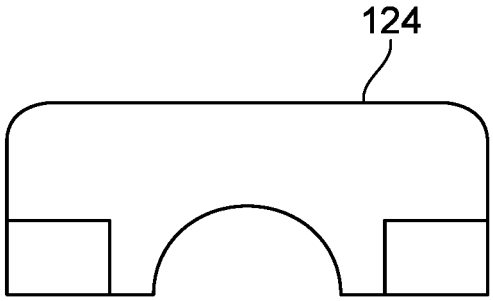
Figure 8C:
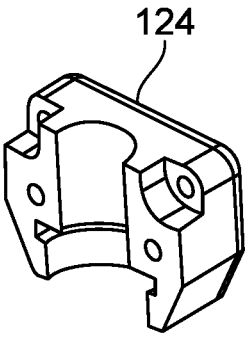
Figure 8D:
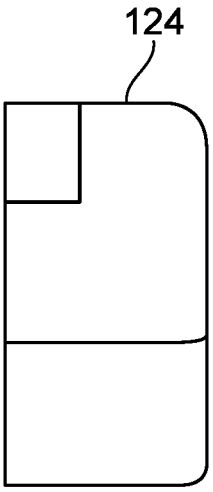
Figure 9A:
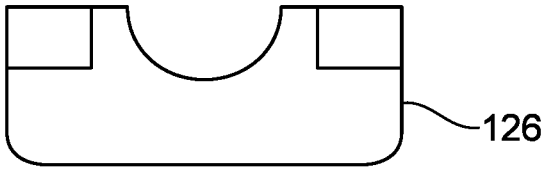
FIG. 9A FIG. 9B FIG. 9C and FIG. 9D illustrates a slider back member of the present invention.
Figure 9B:
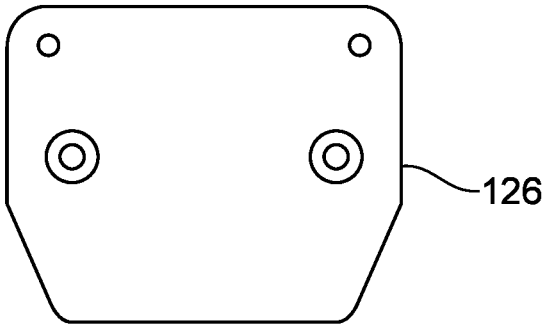
Figure 9C:
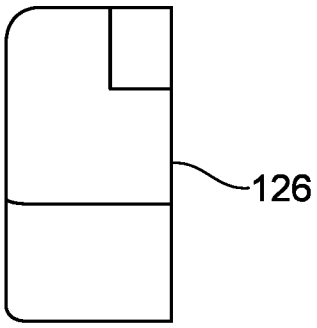
Figure 9D:
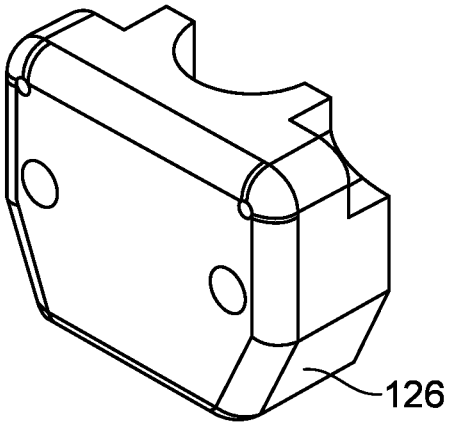

FIGS. 3*a-d* illustrate the pivoting plates of the present invention. FIG. 3*a* illustrates a side view of the pivoting plates which may include a first pivoting plate 102, a second pivoting plate 104, third pivoting plate 106 and a fourth pivoting plate 108. Each end of every pivoting plate is connected by a hinge to pivot to another pivoting plate. Each of the pivoting plates includes a aperture 110 to accept a protrusion 112 of the insert member 114 (not shown).

FIGS. 4*a-d* illustrate an insert member 114 of the present invention and illustrates a substantially rectangular insert member 114 which may be formed from flexible material and may have sufficient friction in order to dust off surfaces which come in contact with the insert member 114. The insert member 114 may additionally have a protrusion 112 which extends from the surface of the insert member 114. The insert member 114 is replaceable and removable. The insert member may be formed from microfiber.

FIGS. 5*a-d* illustrate an pivoting base member 115 of the present invention.

The pivoting base member 115 may include a pair of opposing base pivoting arms 116 which may pivot on a base hinge 118. The pivoting base member 115 connects to pivot the pivoting plate FIGS. 6*a-d* illustrate a hinge member 120 of the present invention. The hinge member 120 may connect to a pair of the ends of the pivoting plates.

FIGS. 7*a-d* illustrate a hinge slider member 122 of the present invention. The hinge slider member 122 may pivot and to connect to the extending arms 124 which extend the pivoting plates.

FIGS. 8*a-d* illustrate a slider front member 126 of the present invention. The slider front member 126 connects with the slider back member 128 to connect the hinge slider member 122 to the connector member 130.

FIGS. 9*a-d* illustrates a slider back member 128 of the present invention. Slider back member 128 connects to the slider front member 126 and in turn and connects with the hinge slider member 122 with the connector member 130

Figure 10A:
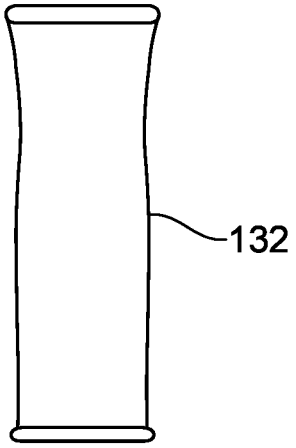
FIG. 10A FIG. 10B and FIG. 10C illustrate the grip member of the present invention.
Figure 10B:
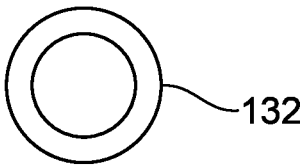
Figure 10C:
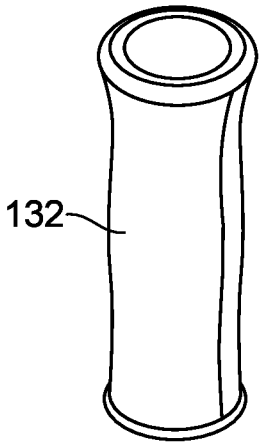

FIGS. 10*a-c* illustrates a grip handle 132 of the present invention.

Figure 11A:
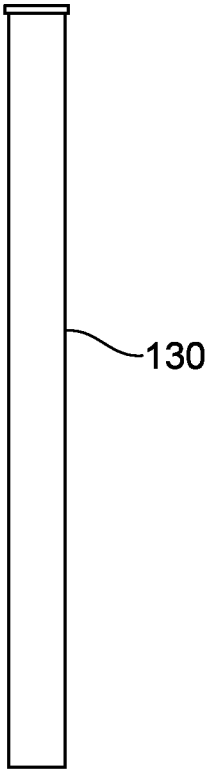
FIG. 11A and FIG. 11B illustrates the connector of the present invention.
Figure 11B:
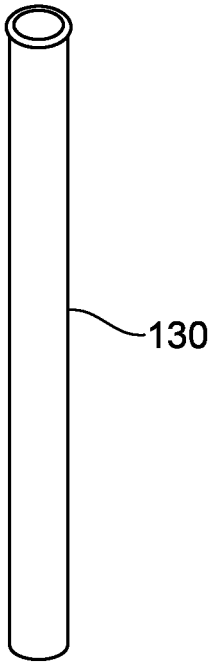

FIGS. 11*a-b* illustrates the connector member 130 of the present invention While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A fan cleaning assembly, comprising:

a first pivoting plate;

a second pivoting plate connected to the first pivoting plate;

a third pivoting plate connected to the first pivoting plate;

a fourth pivoting plate connected to the third pivoting plate;

a first insert member removably connected to the first pivoting plate;

second insert member removably connected to the second pivoting plate;

a third insert member removably connected to the third pivoting plate;

a fourth insert member removably connected to the fourth pivoting plate;

wherein the first insert member, the second insert member, the third insert member and the fourth insert member clean a fan blade of a fan;

wherein the first pivoting plate, the second pivoting plate, the third pivoting plate and the fourth pivoting plate are configured to extend from a closed position to an open position;

wherein the open position is configured by the first pivoting plate, the second pivoting plate, the third pivoting plate and the fourth pivoting plate as a diamond-shaped arrangement.

* * * * *